US011426839B2

(12) United States Patent
Lee

(10) Patent No.: US 11,426,839 B2
(45) Date of Patent: Aug. 30, 2022

(54) HAND TOOL AVAILABLE FOR OPERATING SCREW MEMBERS OF THREE DIFFERENT SPECIFICATIONS

(71) Applicant: Tsan-Chang Lee, Taichung (TW)

(72) Inventor: Tsan-Chang Lee, Taichung (TW)

( * ) Notice: Subject to any disclaimer, the term of this patent is extended or adjusted under 35 U.S.C. 154(b) by 0 days.

(21) Appl. No.: 17/152,856

(22) Filed: Jan. 20, 2021

(65) Prior Publication Data

US 2022/0226969 A1 Jul. 21, 2022

(51) Int. Cl.

| | |
|---|---|
| ***B25B 13/06*** | (2006.01) |
| ***B25B 23/00*** | (2006.01) |
| ***B25B 13/46*** | (2006.01) |

(52) U.S. Cl.

CPC ..... *B25B 13/065* (2013.01); *B25B 23/0035* (2013.01); *B25B 13/463* (2013.01); *B25B 23/0014* (2013.01)

(58) Field of Classification Search

CPC . B25B 13/065; B25B 13/463; B25B 23/0014; B25B 23/0035; B25B 13/06

USPC ..... 81/60, 121.1, 177.5, 177.75, 186

See application file for complete search history.

(56) References Cited

U.S. PATENT DOCUMENTS

| | | | | |
|---|---|---|---|---|
| 3,273,430 | A * | 9/1966 | Knudsen | B25B 13/065 81/124.6 |
| 10,596,685 | B2 * | 3/2020 | Lee | B25B 23/0014 |
| 2004/0020332 | A1 * | 2/2004 | Hsieh | B25B 27/18 81/186 |
| 2010/0058897 | A1 * | 3/2010 | Alsobrook | G09F 23/00 81/121.1 |
| 2015/0273670 | A1 * | 10/2015 | Cheng | B25B 13/065 81/121.1 |
| 2020/0023498 | A1 * | 1/2020 | Cho | B25B 13/065 |
| 2020/0331125 | A1 * | 10/2020 | Eggert | B25B 13/065 |

* cited by examiner

*Primary Examiner* — Orlando E Aviles
*Assistant Examiner* — Sidney D Hohl
(74) *Attorney, Agent, or Firm* — Karin L. Williams; Alan D. Kamrath; Mayer & Williams PC

(57) ABSTRACT

A hand tool includes a body provided with a mounting portion. The mounting portion includes six first recessed portions, six second recessed portions, and six locking faces. Each of the first recessed portions includes two grooves. Each of the second recessed portions includes two first arcuate faces and a second arcuate face. Each of the locking faces has a planar shape and is arranged between two of the second recessed portions. Each of the first recessed portions is arranged on one of the locking faces. The locking faces define an imaginary hexagonal portion having six sides coinciding with the locking faces respectively. The mounting portion of the body is mounted on a screw member. The screw member has six ribs received in the second recessed portions. Each of the ribs rests on one of the first arcuate faces.

13 Claims, 17 Drawing Sheets

A

HAND TOOL AVAILABLE FOR OPERATING SCREW MEMBERS OF THREE DIFFERENT SPECIFICATIONS

BACKGROUND OF THE INVENTION

1. Field of the Invention

The present invention relates to a tool and, more particularly, to a hand tool for operating a screw member.

2. Description of the Related Art

A conventional hand tool was disclosed in the applicant's U.S. Pat. No. 10,596,685, and comprises a body 10 which has a mounting portion 11. The mounting portion 11 includes six side faces 110. Specifically, the mounting portion 11 is defined by an imaginary hexagonal column 20 and the six side faces 110 are located on the side sides of the imaginary hexagonal column 20. Each side face 110 has a function portion 13 formed on the central portion thereof. The function portion 13 is connected between two contact faces 15 of each side face 110. Six curved recesses 14 are defined alternatively between the side faces 110. Each function portion 13 includes two consecutive recesses 131. A peak point 132 is formed between the two consecutive recesses 131 of each side face 110. The peak point 132 of each side face 110 is located on the same plane with the contact faces 15. The imaginary hexagonal column 20 includes an axis 21 and six sides 22. Each side 22 of the imaginary hexagonal column 20 is located corresponding to each contact face 15. The mounting portion 11 of the body 10 is mounted on a screw member 30. The screw member 30 has six corners 31 received in the curved recesses 14. Thus, when the mounting portion 11 of the body 10 is driven to rotate the screw member 30, the corners 31 of the screw member 30 will not be worn out by the mounting portion 11 of the body 10. Preferably, the screw member 30 has a specification of the metric system. However, the mounting portion 11 of the body 10 is only suitable for a single specification, thereby limiting the versatility of the conventional hand tool.

BRIEF SUMMARY OF THE INVENTION

The primary objective of the present invention is to provide a hand tool that is available for operating screw members of three different specifications.

In accordance with the present invention, there is provided a hand tool comprising a body. The body is provided with a mounting portion. The mounting portion includes six first recessed portions, six second recessed portions, and six locking faces. Each of the first recessed portions includes two grooves. Each of the second recessed portions includes two first arcuate faces and a second arcuate face. Each of the locking faces has a planar shape. Each of the locking faces is arranged between two of the second recessed portions. Each of the first recessed portions is arranged on one of the locking faces. The locking faces define an imaginary hexagonal portion. The imaginary hexagonal portion has a center provided with an axis. The imaginary hexagonal portion has six sides. Each of the six sides coincides with each of the locking faces. The mounting portion of the body is mounted on a screw member. The screw member has six ribs received in the second recessed portions. Each of the ribs rests on one of the first arcuate faces.

According to the primary advantage of the present invention, the mounting portion is provided with the second recessed portions, so that the mounting portion is allowed to mount screw members of three different specifications, thereby enhancing the versatility of the hand tool.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
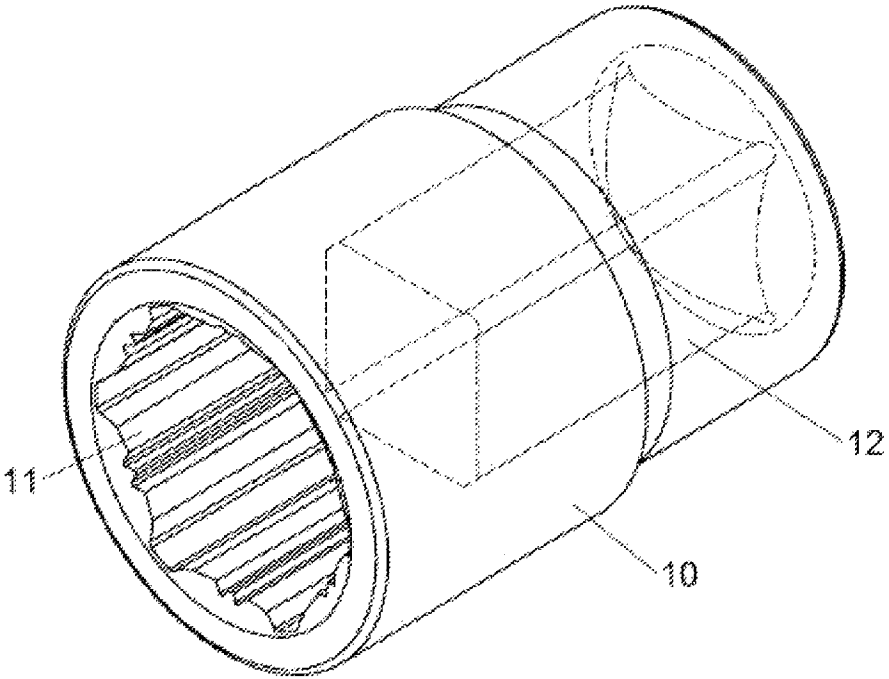
FIG. 1 is a perspective view of a hand tool in accordance with the first preferred embodiment of the present invention.
Figure 2:
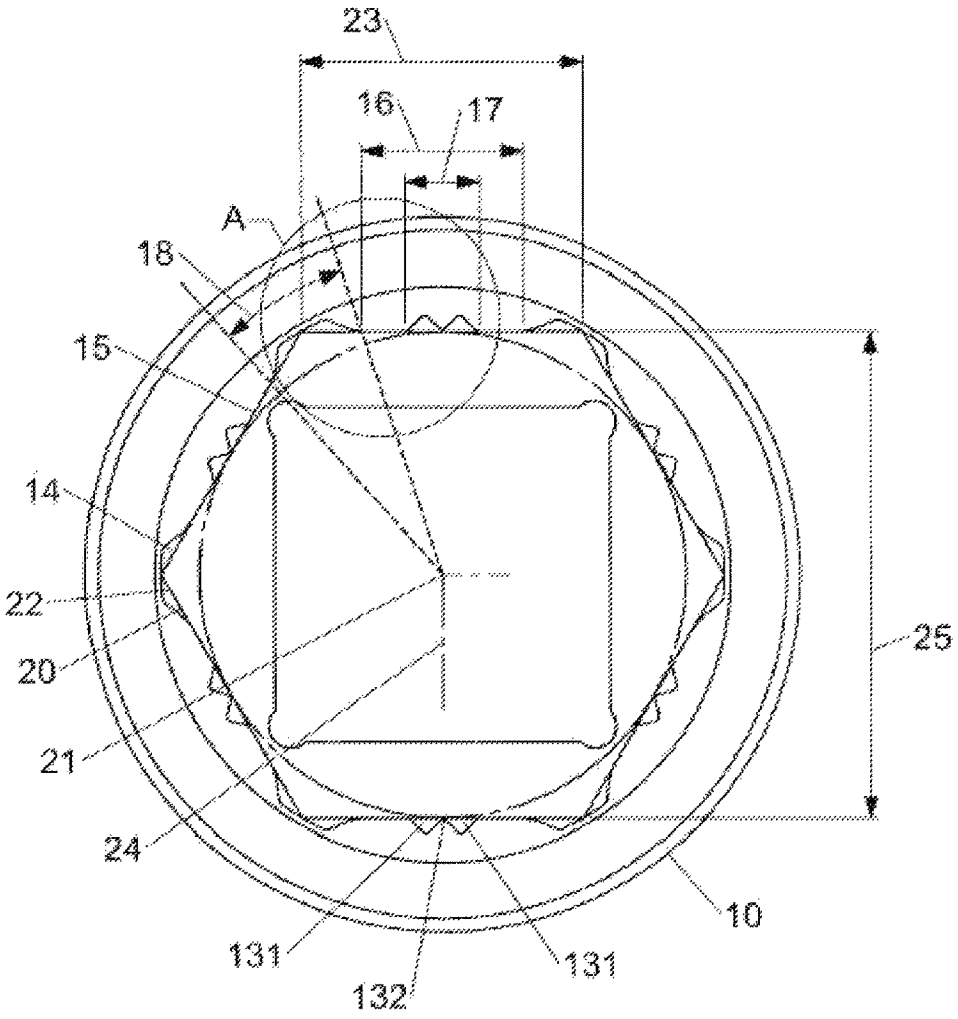
FIG. 2 is a front view of the hand tool in accordance with the first preferred embodiment of the present invention.
Figure 3:
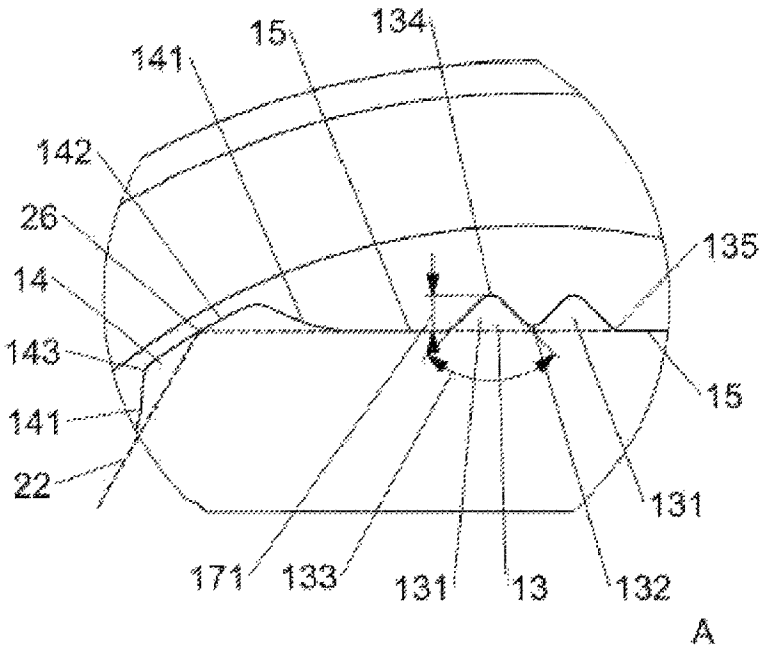
FIG. 3 is a locally enlarged view of the hand tool taken along circle "A" as shown in FIG. 2.

Referring to the drawings and initially to FIGS. 1-3, a hand tool in accordance with the preferred embodiment of the present invention comprises a body 10. The body 10 has a cylindrical shape. The body 10 includes a socket structure. The body 10 has a first end provided with a mounting portion 11. The mounting portion 11 has a hexagonal recess. The body 10 has a second end provided with a driving portion 12. The driving portion 12 has a square recess. The driving portion 12 is mounted on another hand tool.

The mounting portion 11 includes six first recessed portions 13, six second recessed portions 14, and six locking (or contact) faces 15. The first recessed portions 13, the second recessed portions 14, and the locking faces 15 are arranged alternately in an annular manner.

Each of the first recessed portions 13 includes two grooves 131. Each of the two grooves 131 presents an equilateral triangular shape. Each of the first recessed portions 13 has a first guide corner 132 defined between the two grooves 131. The first guide corner 132 has an arcuate shape. The first guide corner 132 connects the two grooves 131. A first angle 133 is defined between two sides of each of the two grooves 131. The first angle 133 is about 90 degrees optimally. Each of the two grooves 131 has a bottom formed with a second guide corner 134. Thus, each of the first recessed portions 13 has two second guide corners 134, and the first guide corner 132 is arranged between the two second guide corners 134. The second guide corner 134 has an arcuate shape. The second guide corner 134 has a radius equal to that of the first guide corner 132. Each of the first recessed portions 13 has two ends each formed with a third guide corner 135. The third guide corner 135 has an arcuate shape. The third guide corner 135 has a radius equal to that of the first guide corner 132. Each of the first recessed portions 13 is arranged between two of the second recessed portions 14.

Each of the second recessed portions 14 includes two first arcuate faces 141 and a second arcuate face 142. The second arcuate face 142 is arranged between the two first arcuate faces 141. The two first arcuate faces 141 are arranged symmetrically relative to the second arcuate face 142. Each of the first arcuate faces 141 and the second arcuate face 142 have a connection formed with a fourth guide corner 143. The fourth guide corner 143 has an arcuate shape. It is to be noted that, the second arcuate face 142 has a large radius so that the second arcuate face 142 is close to a plane.

Each of the locking faces 15 has a planar shape. Each of the locking faces 15 is arranged between two of the second recessed portions 14. Each of the first recessed portions 13 is arranged on one of the locking faces 15. The first guide corner 132 of the two grooves 131 is located at an extending line of each of the locking faces 15. Each of the locking faces 15 has two ends each connecting one of the second recessed portions 14. Each of the locking faces 15 is arranged between one of the first arcuate faces 141 of one of the second recessed portions 14 and one of the first arcuate faces 141 of another one of the second recessed portions 14. Each of the locking faces 15 is tangent to each of the first arcuate faces 141.

Each of the locking faces 15 defines a first length 16. Each of the first recessed portions 13 containing the third guide corner 135 defines a second length 17. The second length 17 is optimally one half (½) of the first length 16. A height 171 is defined between each of the two grooves 131 and each of the locking faces 15. Thus, the height 171 is defined between the second guide corner 134 and each of the locking faces 15. A second angle 18 is defined between two lines each of which passes through an end of each of the first arcuate faces 141 and an axis (or a center) of the body 10. The second angle 18 is about 25 degrees optimally or about 30 degrees optimally.

The locking faces 15 define an imaginary hexagonal portion 20. The imaginary hexagonal portion 20 has a center provided with an axis 21 which coincides with the axis of the body 10. The second arcuate face 142 has a center located at the axis 21. The imaginary hexagonal portion 20 has six sides 22. Each of the six sides 22 corresponds to and coincides with each of the locking faces 15. Each of the six sides 22 defines a third length 23. The first length 16 is about 0.5 to 0.6 of the third length 23. For example, when the third length 23 is 10 mm, the first length 16 is 5 mm to 6 mm. The axis 21 has an imaginary perpendicular line 24 which is perpendicular to the axis 21. The first guide corner 132 has a center that is located at the perpendicular line 24. The imaginary hexagonal portion 20 has a fourth length 25 that is defined between any two parallel facing sides 22 of the imaginary hexagonal portion 20. The height 171 is 0.03 to 0.04 of the fourth length 25. Optimally, the height 171 is 0.03 to 0.035 of the fourth length 25. Any two adjacent sides 22 of the imaginary hexagonal portion 20 have an intersection 26. The intersection 26 is located at the second arcuate face 142. Alternatively, the second arcuate face 142 is located outside of the intersection 26.

Figure 4:
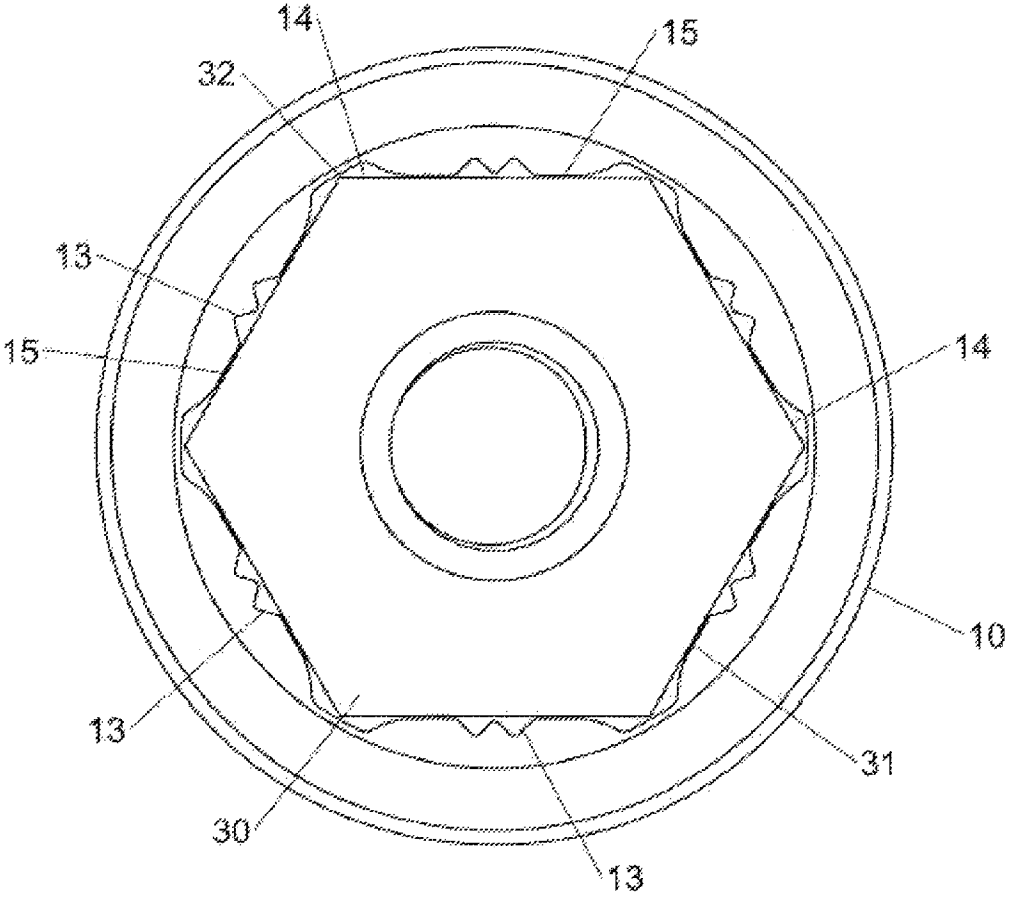
FIG. 4 is a front view showing the hand tool engaging a first screw member in accordance with the present invention.

Referring to FIG. 4, the mounting portion 11 of the body 10 is mounted on a first screw member 30. The first screw member 30 has six first sides 31 locked by the locking faces 15. The first screw member 30 has six first corners 32 received in the second recessed portions 14. Thus, when the mounting portion 11 of the body 10 is driven to rotate the first screw member 30, the first corners 32 of the first screw member 30 are not worn out by the mounting portion 11 of the body 10. Preferably, the first screw member 30 has a specification of the metric system.

Figure 5:
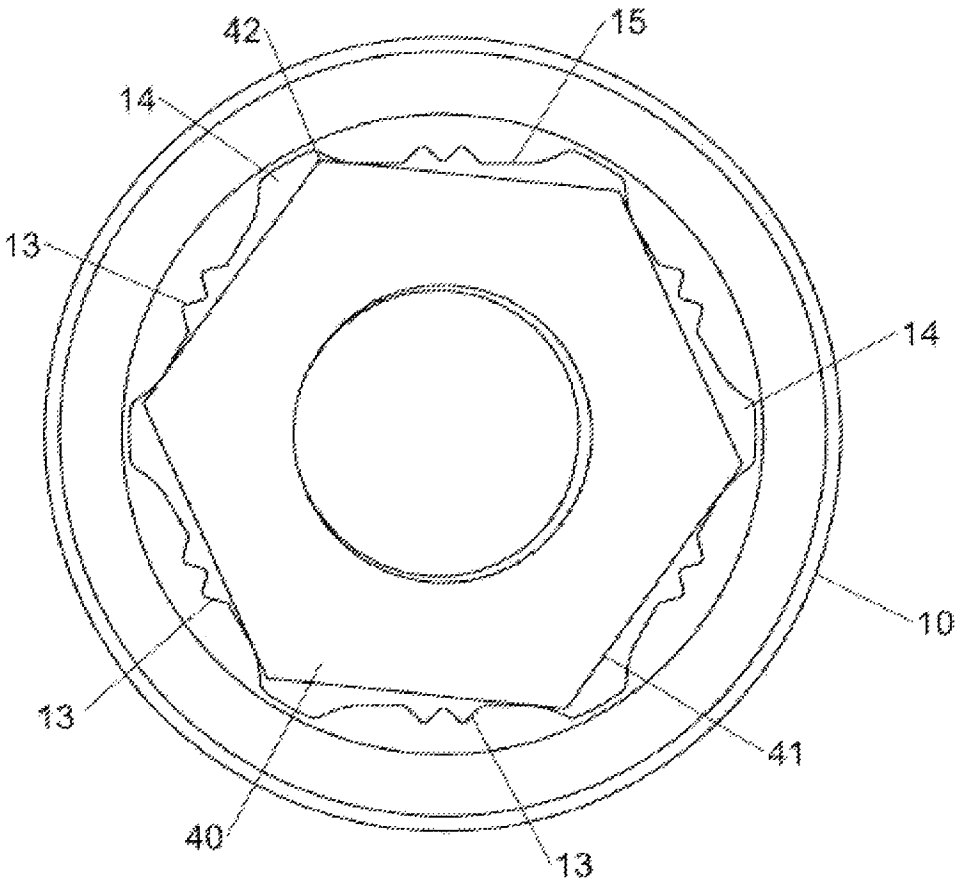
FIG. 5 is a front view showing the hand tool engaging a second screw member in accordance with the present invention.

Referring to FIG. 5, the mounting portion 11 of the body 10 is mounted on a second screw member 40. The second screw member 40 has six second sides 41 each abutting one of the first arcuate faces 141 and each abutting one of the locking faces 15. The second screw member 40 has six second corners 42 received in the second recessed portions 14. Thus, when the mounting portion 11 of the body 10 is driven to rotate the second screw member 40, the second corners 42 of the second screw member 40 are not worn out by the mounting portion 11 of the body 10. Preferably, the second screw member 40 has a specification of the British system.

Figure 6:
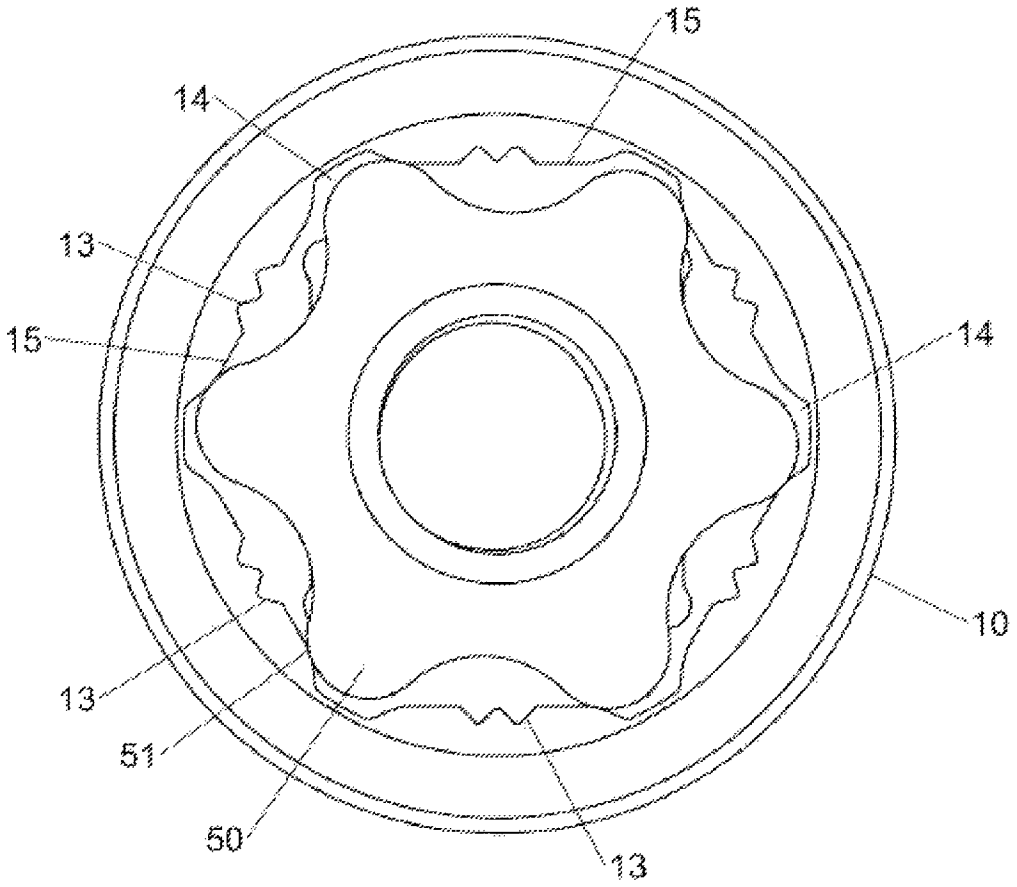
FIG. 6 is a front view showing the hand tool engaging a second screw member in accordance with the present invention.

Referring to FIG. 6, the mounting portion 11 of the body 10 is mounted on a third screw member 50. The third screw member 50 has six ribs 51 received in the second recessed portions 14. The six ribs 51 are arranged in an annular shape. Each of the ribs 51 rests on one of the first arcuate faces 141. The third screw member 50 has a star shape Preferably, the third screw member 50 has a E-type specification.

Figure 7:
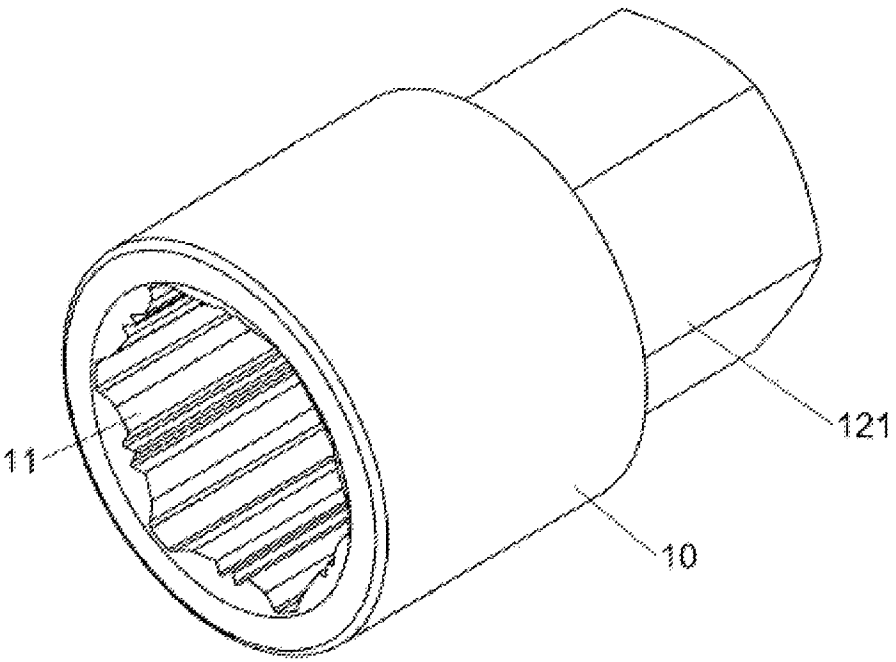
FIG. 7 is a perspective view of a hand tool in accordance with the second preferred embodiment of the present invention.

Referring to FIG. 7, the body 10 includes a socket 121 which has a passage defined axially therethrough.

Figure 8:
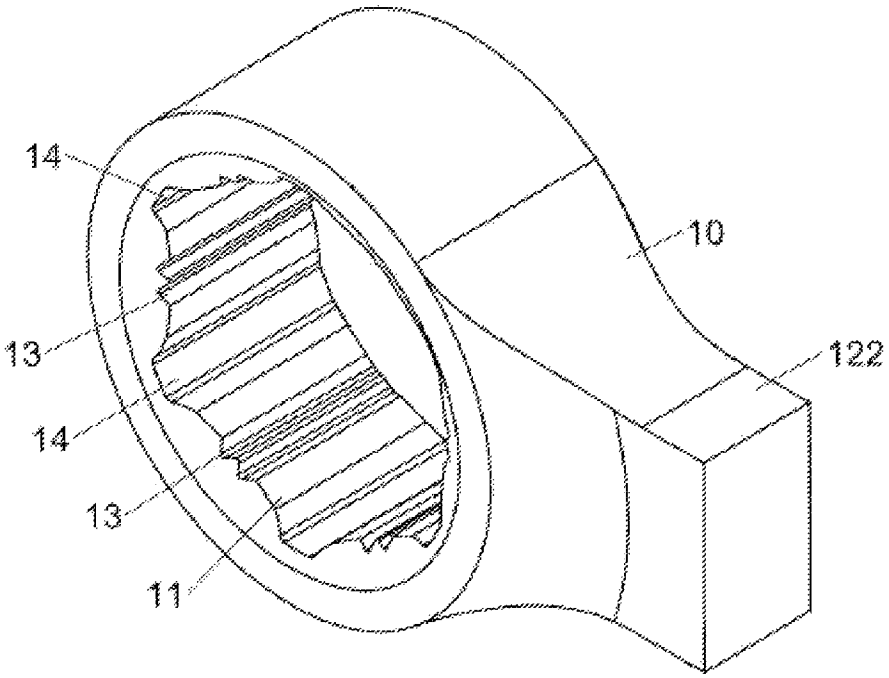
FIG. 8 is a perspective view of a hand tool in accordance with the third preferred embodiment of the present invention.

Referring to FIG. 8, the body 10 includes a closed wrench 122.

Figure 9:
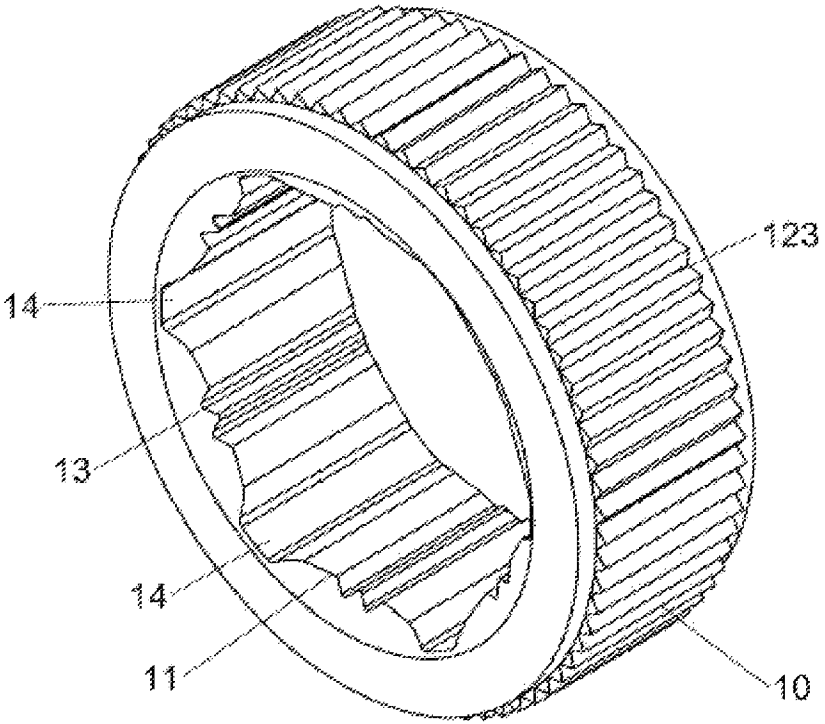
FIG. 9 is a perspective view of a hand tool in accordance with the fourth preferred embodiment of the present invention.

Referring to FIG. 9, the body 10 includes a ratchet mechanism 123.

Figure 10:
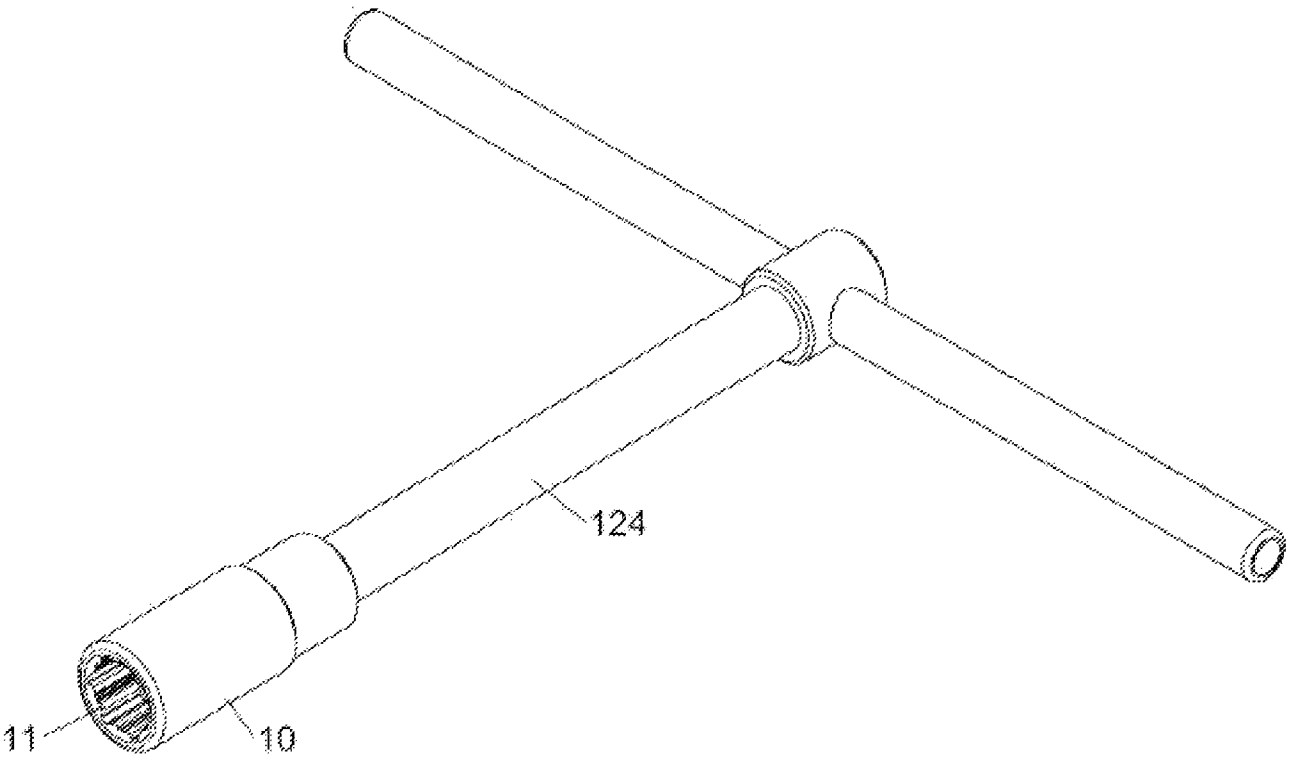
FIG. 10 is a perspective view of a hand tool in accordance with the fifth preferred embodiment of the present invention.

Referring to FIG. 10, the body 10 includes a first slide rod 124.

Figure 11:
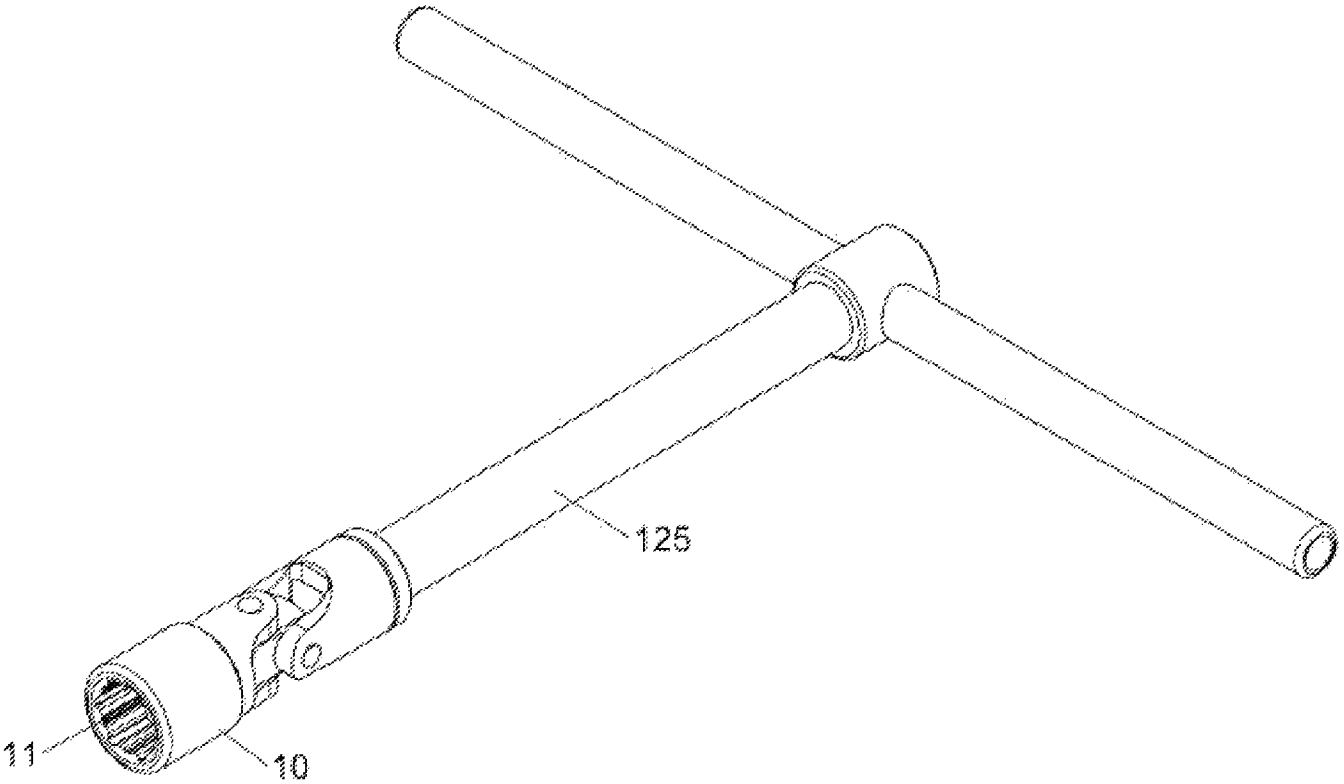
FIG. 11 is a perspective view of a hand tool in accordance with the sixth preferred embodiment of the present invention.

Referring to FIG. 11, the body 10 includes a second slide rod 125 with a universal connector.

Figure 12:
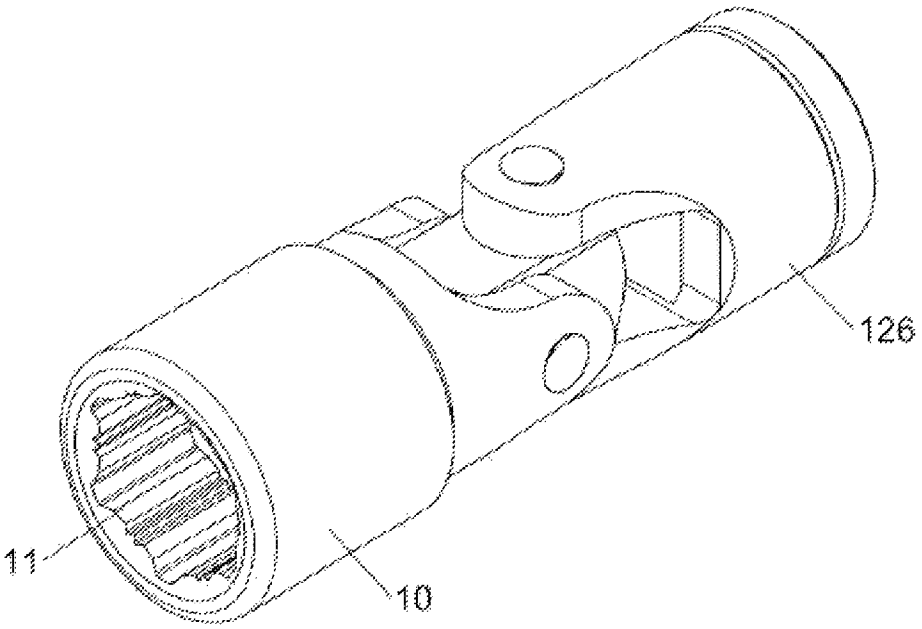
FIG. 12 is a perspective view of a hand tool in accordance with the seventh preferred embodiment of the present invention.

Referring to FIG. 12, the body 10 includes a universal connector 126.

Figure 13:
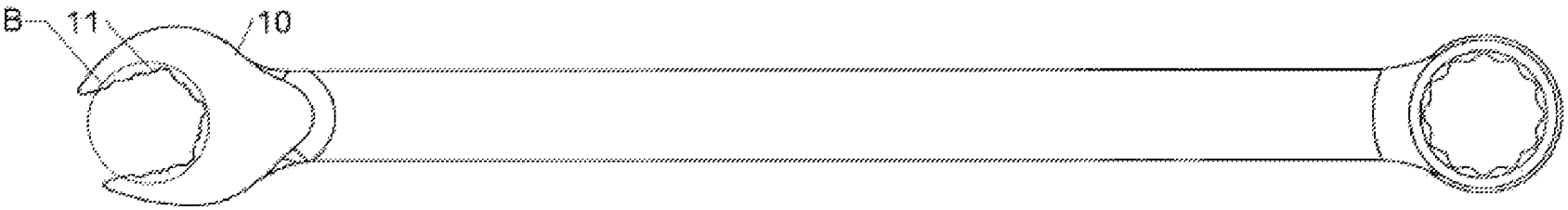
FIG. 13 is a top view of a hand tool in accordance with the eighth preferred embodiment of the present invention.
Figure 14:
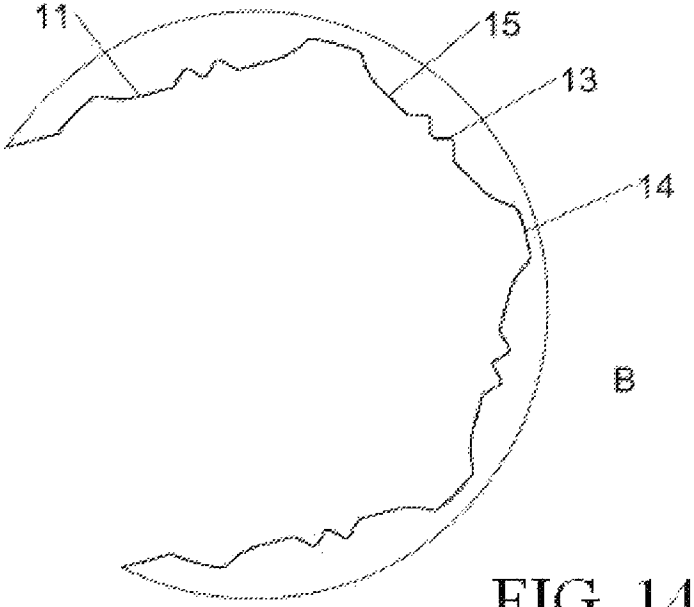
FIG. 14 is a locally enlarged view of the hand tool taken along circle "B" as shown in FIG. 13.

Referring to FIGS. 13 and 14, the body 10 includes a combination wrench, and the mounting portion 11 of the body 10 is an open ended wrench.

Figure 15:
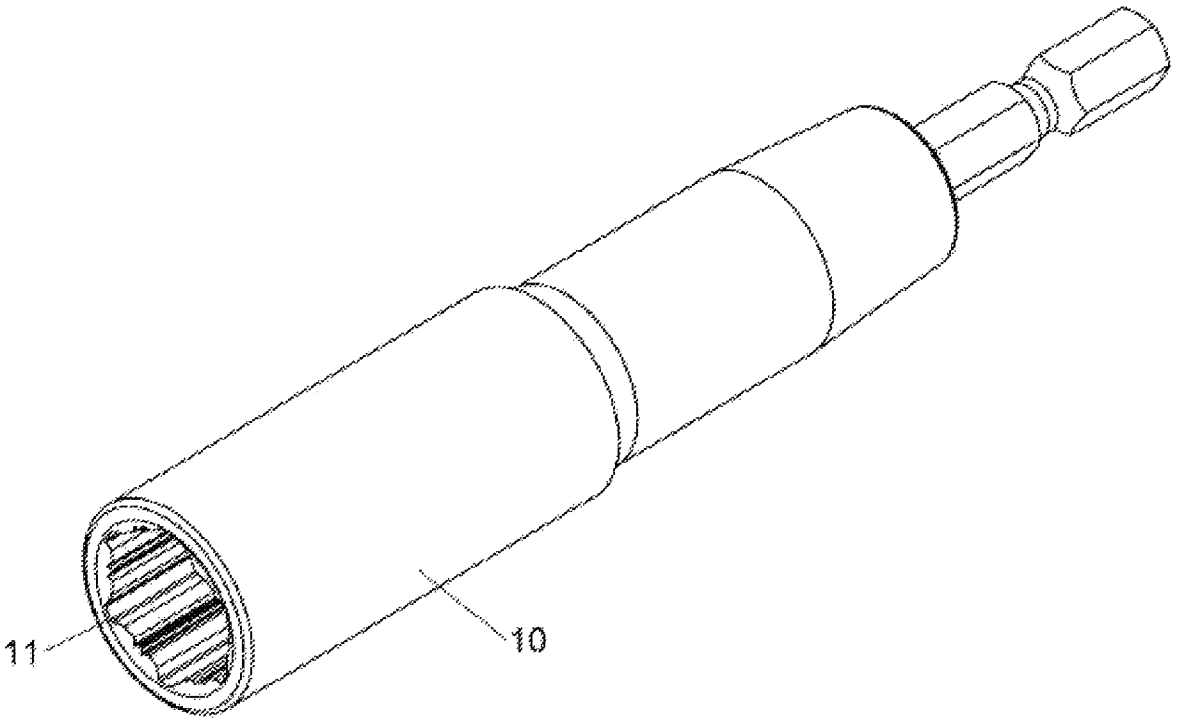
FIG. 15 is a perspective view of a hand tool in accordance with the ninth preferred embodiment of the present invention.

Referring to FIG. 15, the body 10 is connected with a hexagonal rod. The hexagonal rod is distant from the mounting portion 11.

Figure 16:
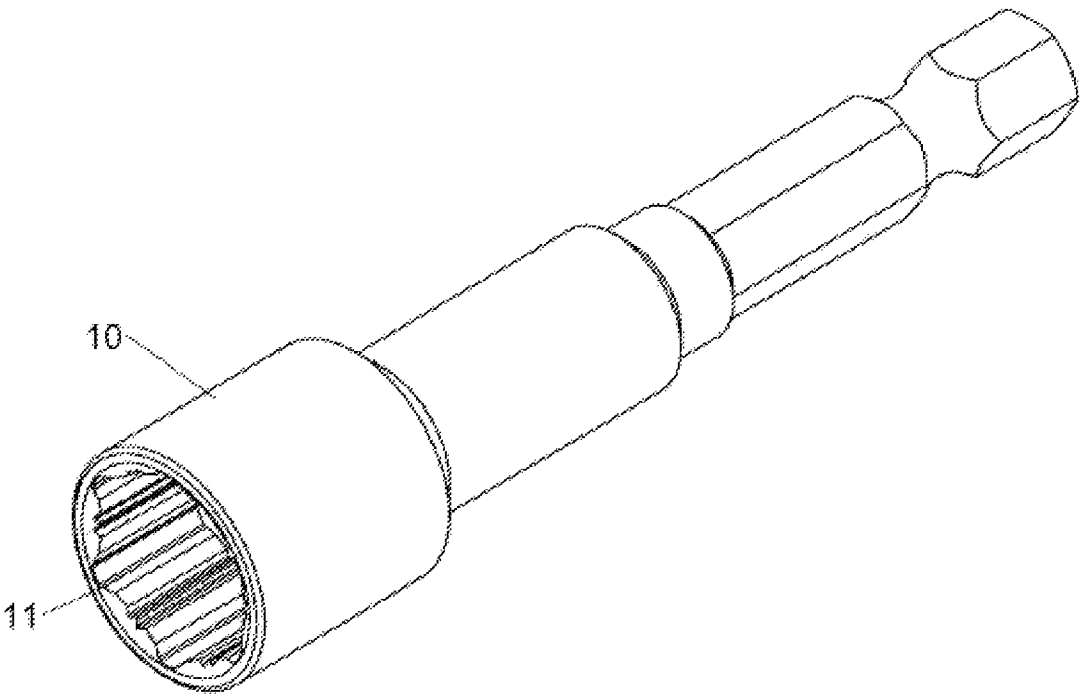
FIG. 16 is a perspective view of a hand tool in accordance with the tenth preferred embodiment of the present invention.

Referring to FIG. 16, the body 10 is formed integrally with a hexagonal rod. The hexagonal rod is distant from the mounting portion 11.

Figure 17:
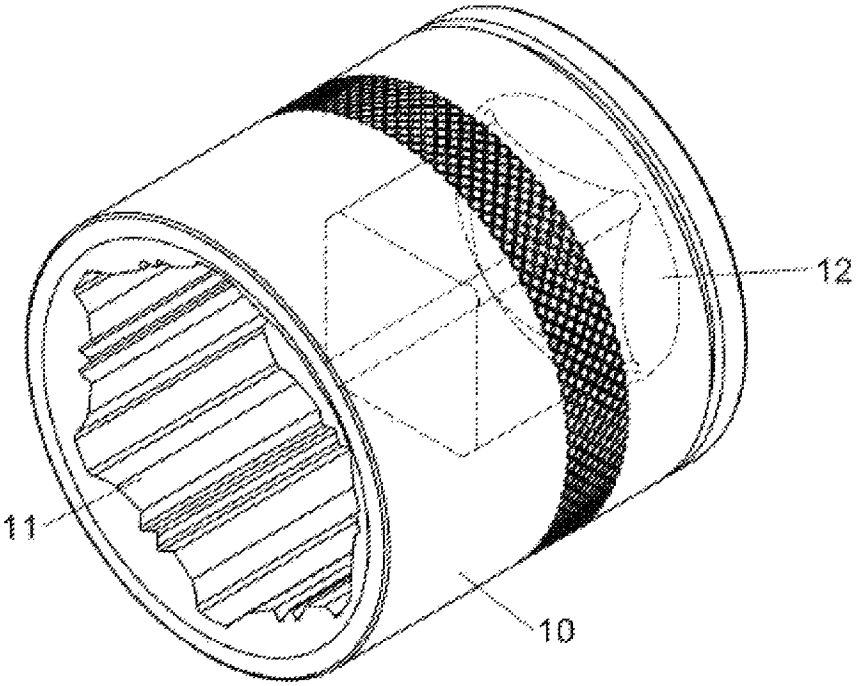
FIG. 17 is a perspective view of a hand tool in accordance with the eleventh preferred embodiment of the present invention.

Referring to FIG. 17, the body 10 includes a socket structure. The body 10 has a peripheral face provided with an annular knurling (or embossing) portion and an annular groove. The annular groove is close to the driving portion 12.

Figure 18:
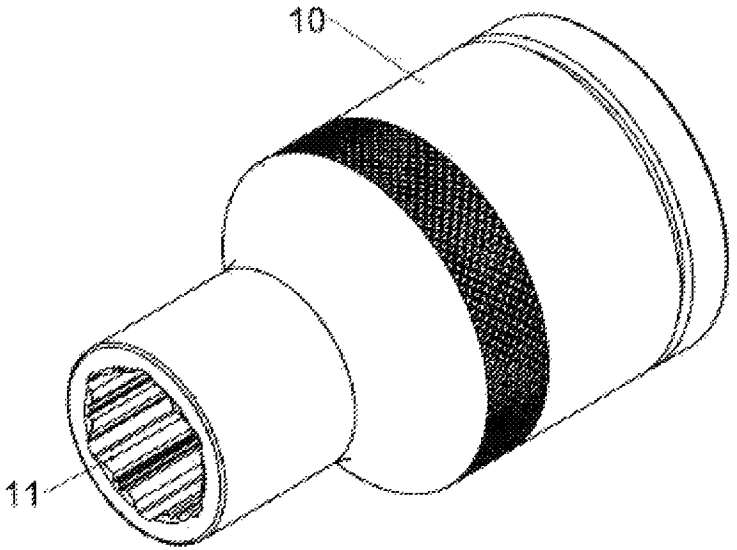
FIG. 18 is a perspective view of a hand tool in accordance with the twelfth preferred embodiment of the present invention.

Referring to FIG. 18, the body 10 includes a stepped socket structure. The body 10 has a peripheral face provided with an annular knurling (or embossing) portion and an annular groove. The annular groove is close to the driving portion 12.

Figure 19:
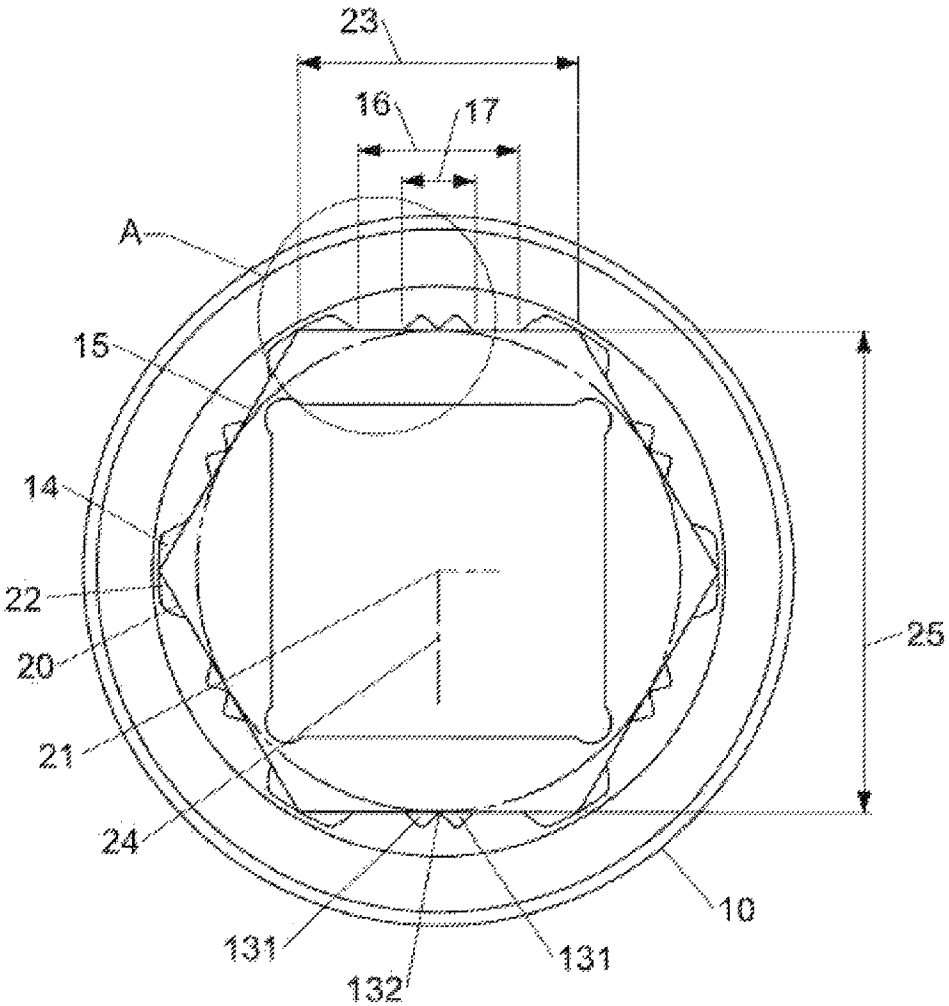
FIG. 19 is a front view of a hand tool in accordance with the thirteenth preferred embodiment of the present invention.
Figure 20:
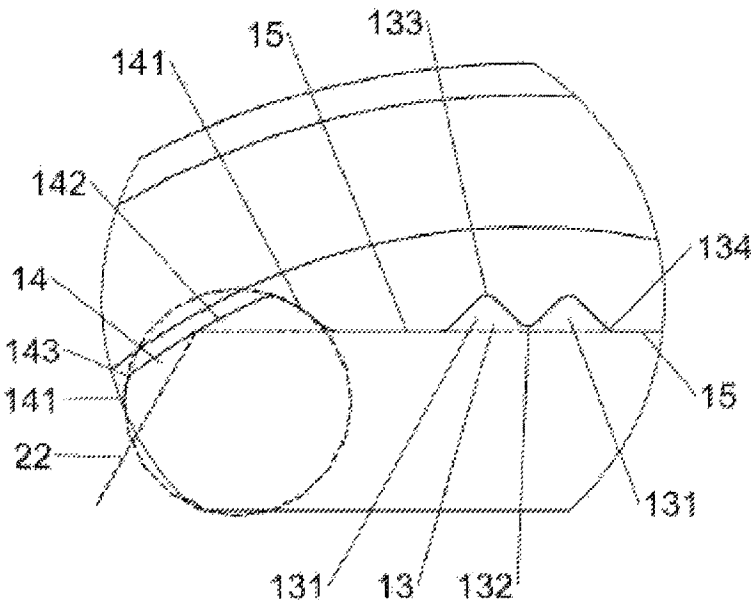
FIG. 20 is a locally enlarged view of the hand tool taken along circle "A" as shown in FIG. 19.

Referring to FIGS. 19 and 20, the two first arcuate faces 141 of each of the second recessed portions 14 construct a circle, and the intersection 26 is encircled by the circle.

The hand tool of the present invention has the following advantages.

1. Referring to FIGS. 4-6, the mounting portion 11 is provided with the second recessed portions 14, so that the mounting portion 11 is allowed to mount the first screw member 30, the second screw member 40, and the third screw member 50 of three different specifications, thereby enhancing the versatility of the hand tool.

2. The first corners 32 of the first screw member 30 are received in the second recessed portions 14, the second corners 42 of the second screw member 40 are received in the second recessed portions 14, and the ribs 51 of the third screw member 50 are received in the second recessed portions 14, so that the mounting portion 11 allows mounting of the first screw member 30, the second screw member 40, and the third screw member 50.

3. Each of the second recessed portions 14 is provided with the first to arcuate faces 141, the second arcuate face 142, the fourth guide corner 143, and the second angle 18, so that the second recessed portions 14 are allowed to receive the ribs 51 of the third screw member 50.

4. The second arcuate face 142 coincides with the intersection 26, or the second arcuate face 142 is close to and slightly located outside of the intersection 26, so that the body 10 has more thickness to enhance the structural strength of the body 10.

5. Referring to FIG. 4, when the mounting portion 11 of the body 10 is mounted on the first screw member 30, the first corners 32 of the first screw member 30 are received in the second recessed portions 14 of the body 10, so that when the mounting portion 11 of the body 10 is driven to rotate the first screw member 30, the first corners 32 of the first screw member 30 will not be rubbed or worn out by the mounting portion 11 of the body 10.

6. The mounting portion 11 is provided with the locking faces 15 so that the body 10 has a structure similar to that of a conventional mounting portion with a hexagonal recess.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A hand tool comprising:

a body;

wherein:

the body has a first end provided with a mounting portion;

the mounting portion has a hexagonal recess;

the mounting portion includes six first recessed portions; six second recessed portions, and six locking faces;

each of the first recessed portions includes two grooves;

each of the first recessed portions has a first guide corner defined between the two grooves;

the first guide corner has an arcuate shape;

a first angle is defined between two sides of each of the two grooves;

each of the two grooves has a bottom formed with a second guide corner;

each of the first recessed portions has two second guide corners, and the first guide corner is arranged between the two second guide corners;

the second guide corner has an arcuate shape;

each of the first recessed portions has two ends each thrilled with a third guide corner;

the third guide corner has an arcuate shape;

each of the first recessed portions is arranged between two of the second recessed portions;

each of the second recessed portions includes two first arcuate faces and a second arcuate face;

the second arcuate face is arranged between the two first arcuate faces;

the two first arcuate faces are arranged symmetrically relative to the second arcuate face;

each of the first arcuate faces and the second arcuate face have a connection formed with a fourth guide corner;

the fourth guide corner has an arcuate shape;

each of the locking faces has a flat planar shape;

each of the locking faces is arranged between two of the second recessed portions;

each of the first recessed portions is arranged on one of the locking faces;

each of the locking faces has two ends each connecting one of the second recessed portions;

each of the locking faces is arranged between one of the first arcuate faces of one of the second recessed portions and one of the first arcuate faces of another one of the second recessed portions;

each of the locking faces is tangent to each of the first arcuate faces;

each of the locking faces defines a first length;

each of the first recessed portions containing the third guide corner defines a second length;

the second length is smaller than the first length;

a height is defined between each of the two grooves and each of the locking faces;

the height is defined between the second guide corner and each of the locking faces;

a second angle is defined between two lines each of which passes through an end of each of the first arcuate faces and an axis of the body;

the locking faces define an imaginary hexagonal portion;

the imaginary hexagonal potion has a center provided with an axis;

the second arcuate face has a center located at the axis;

the imaginary hexagonal portion has six sides;

each of the six sides coincides with each of the locking faces;

each of the six sides defines a third length;

the first length is smaller than the third length;

the axis has an imaginary perpendicular line which is perpendicular to the axis;

the first guide corner has a center that is located at the perpendicular line;

the imaginary hexagonal portion has a fourth length that is defined between any two parallel facing sides of the imaginary hexagonal portion;

the height is smaller than the fourth length;

any two adjacent sides of the imaginary hexagonal portion have an intersection; and the intersection is located at the second arcuate face.

2. The hand tool as claimed in claim 1, wherein:

the body has a cylindrical shape;

the body includes a socket structure;

the body has a second end provided with a driving portion; and the driving portion has a square recess.

3. The hand tool as claimed in claim 1, wherein the body includes a socket which has a passage defined axially therethrough, or the body includes a closed wrench, or the body includes a ratchet mechanism.

4. The hand tool as claimed in claim 1, wherein the body includes a socket structure, and the body has a peripheral face provided with an annular knurling portion.

5. The hand tool as claimed in claim 1, wherein the two first arcuate faces of each of the second recessed portions construct a circle, and the intersection is encircled by the circle.

6. The hand tool as claimed in claim 1, wherein the intersection is located at a middle of the second arcuate face.

7. The hand tool as claimed in claim 1, wherein each of the two grooves presents an equilateral triangular shape.

8. The hand tool as claimed in claim 1, wherein the first angle is equal to 90 degrees.

9. The hand tool as claimed in claim 1, wherein the second guide corner has a radius equal to that of the first guide corner.

10. The hand tool as claimed in claim 1, wherein the third guide corner has a radius equal to that of the first guide corner.

11. The hand tool as claimed in claim 1, wherein the mounting portion with the second recessed portions is allowed to mount a first screw member, a second screw member, and a third screw member of three different specifications.

12. The hand tool as claimed in claim 1, wherein the first arcuate faces and the second arcuate face form a trapezium configuration.

13. The hand tool as claimed in claim 1, wherein each of the first arcuate faces has a length less than that of the second arcuate face.

* * * * *